United States Patent [19]

Murofushi et al.

[11] 4,347,504

[45] Aug. 31, 1982

[54] DEVICE FOR DETECTING A BURNT-OUT FUSE

[75] Inventors: Satoru Murofushi, Shizuoka; Tadao Shibuya, Fujieda; Shinichi Kato, Fujisawa; Mitsuo Endo, Gotenba, all of Japan

[73] Assignees: Nissan Motor Co., Ltd., Kanagawa; Yazaki Corporation, Tokyo, both of Japan

[21] Appl. No.: 179,999

[22] Filed: Aug. 21, 1980

[30] Foreign Application Priority Data

Aug. 24, 1979 [JP] Japan ..... 54-115900[U]

[51] Int. Cl.[3] ..... G08B 21/00

[52] U.S. Cl. ..... 340/638; 200/5 A; 340/365 R

[58] Field of Search ..... 340/638, 365 R, 514; 200/5 A

[56] References Cited

U.S. PATENT DOCUMENTS 1,645,346 10/1927 Palmer ..... 340/638 X
3,699,294 10/1972 Sudduth ..... 200/5 A X
3,745,287 7/1973 Walker ..... 200/5 A X

FOREIGN PATENT DOCUMENTS 1018900 10/1952 France ..... 340/638
51-42450 3/1976 Japan .
2034542 6/1980 United Kingdom .

*Primary Examiner*—John W. Caldwell, Sr.
*Assistant Examiner*—Daniel Myer
*Attorney, Agent, or Firm*—Balogh, Osann, Kramer, Dvorak, Genova & Traub

[57] ABSTRACT

A device for detecting a burnt-out fuse in a fuse box accommodating a plurality of parallelly arranged blade-type fuses. The device comprises an insulative support body mounted to the fuse box, an electrically conductive rubber member carried on said support body and a light emitting element connected between said rubber bar member and ground. The rubber bar member faces the output sides of the blade type fuses accommodated in the fuse box such that the rubber bar member acts as a contact means ready for depressing.

5 Claims, 3 Drawing Figures

DEVICE FOR DETECTING A BURNT-OUT FUSE

The present invention relates to a device for detecting a burnt-out blade type fuse mounted in a fuse box, such as in the wire harness for an automobile or the like.

An object of the invention is to provide a device for detecting a burnt-out fuse with a simple construction in which the contacts to be brought into contact with the blade type fuses are made of conductive rubber and the resiliency of the conductive rubber is efficiently utilized for resetting the contacts.

A preferred embodiment of the invention will be described hereinunder with reference to the accompanying drawings in which.

Figure 1:
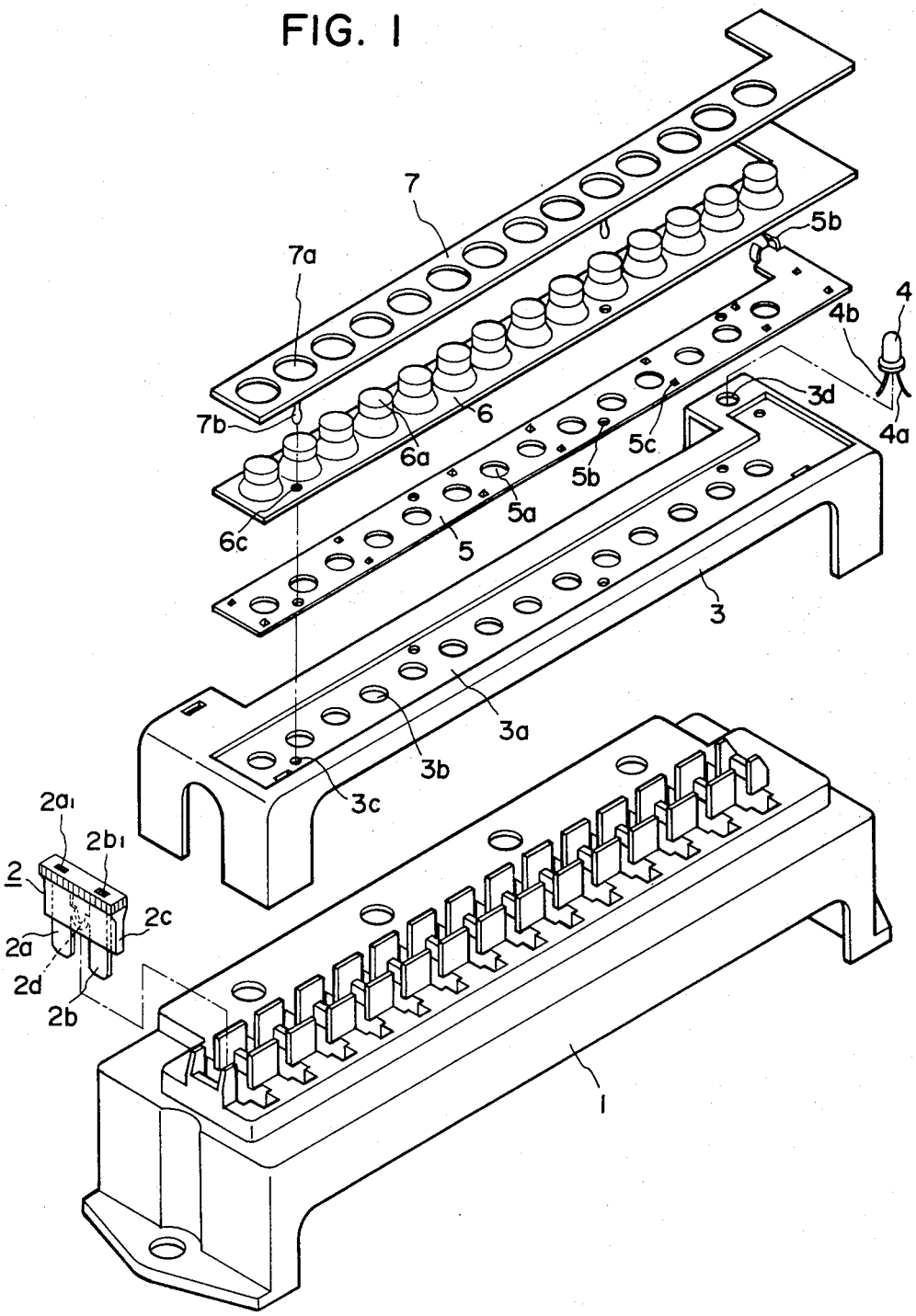
FIG. 1 is an exploded perspective view of an embodiment of the invention.

Referring first to FIG. 1 showing the whole part of the detecting device of the invention together with a fuse box in an exploded perspective view, the fuse box 1 is adapted to receive 14 (fourteen) blade type fuses 2 therein. Each of the fuses is constituted by two blades 2*a*, 2*b*, fuseable portion 2*d* bridging the blades 2*a*, 2*b* and a case for locating the blades 2*a*, 2*b* and covering the fuseable portion 2*d*. Heads $2a_1$, $2b_1$ of the blades 2*a*, 2*b* are exposed from the upper face of the case 2*c*.

A reference numeral 3 denotes a support body of the detecting device in the form of a panel made of an insulating material, and is adapted to be fixed to the upper face of the fuse box 1 by means of a suitable fixing member which is not shown. The support body 3 has an L-shaped recess 3*a* and has large bores 3*b* which are located in vertical alignment with the heads $2b_1$ of the output side blades 2*b* of fuses 2. Thus, there are 14 (fourteen apertures) apertures formed in the recess 3*a*. Also, there are 5 (five) small apertures 3*c* formed at suitable portions. A reference numeral 3*d* denotes a hole to which a light emitting diode 4 is attached.

A reference numeral 5 denotes a grounding plate adapted to fit in the recessed surface 3*a* of the support body 3 and having large apertures 5*a* and small apertures 5*b* corresponding to the large and small apertures 3*b*, 3*c* of the support body 3. The grounding plate 5 further has a cut-out pin 5*c*. A reference numeral 5*d* denotes a portion to be connected to the anode-side lead 4*a* of the light emitting diode 4.

A reference numeral 6 denotes a contact bar made of an electrically conductive rubber and having a planar shape conforming to the shape of the recess 3*a* of the support body 3. The contact bar 6 is provided with 14 (fourteen) contacts 6*a* formed integrally at portions thereof corresponding to the large apertures 3*b* of the support body 3. Each contact 6*a* is constituted by a resilient reset portion $6a_1$ in the form of hollow conical projection protruding from the major surface 6*b* and a contact portion $6a_2$ supported by the resilient reset portion $6a_1$. Five small apertures 6*c* corresponding to the small apertures 3*c* of the main body 3 are formed in the other portion of the flat part 6*b*.

A reference numeral 7 denotes an insulating contact holding member having a shape corresponding to the recessed part 3*a* of the support body 3. At the same time, apertures 7*a* for receiving the contacts 6*a* of the contact bar 6 are formed in the contact holding member 7. Also, 5 (five) pins are provided to extend from the lower side of the contact holding member 7 through the small apertures 6*c* and 5*b* of the contact bar 6 and the grounding plate 5. These pins 7*b* fit in the small apertures 3*c* of the support body 3.

For detecting a blow fuse, the grounding plate 5 is fitted to the recessed part 3*a* of the support body 3. At the same time, the connecting portion 5*d* of the grounding plate 5 is connected to the anode-side lead 4*a* of the light emitting diode 4 fitted to the hole 3*d* of the support body 3. Then, the contact bar 6 is fitted on the grounding plate 5 and the contact holding member 7 is placed and fitted on the contact bar 6, such that the location pins 7*b* of the contact holding member 7 extend through the small apertures 6*c* and 5*b* of the contact bar 6 and the grounding plate 5 to fit the small apertures 3*c* of the support body 3 thereby to unite the contact bar 6 and the grounding plate 5 with the support body 3. In this state, the cut-out pin 5*c* of the grounding plate 5 bites into the contact bar 6 to make electric contact with the latter.

Figure 2:
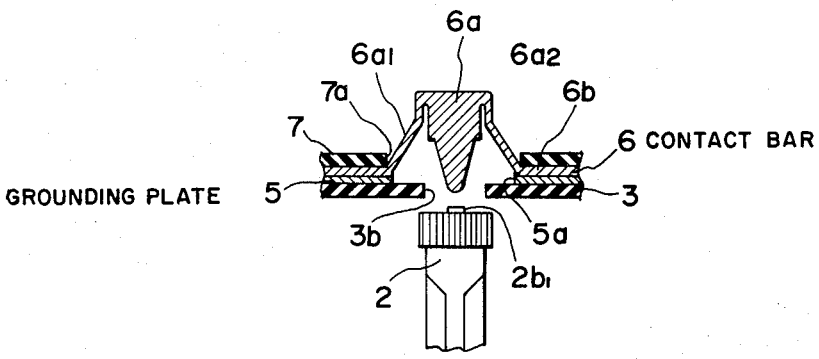
FIG. 2 is a sectional view of an essential part of the embodiment shown in FIG. 1.

FIG. 2 shows the positional relationship between the fuses 2 and the contacts 6*a* of the detecting device thus assembled and attached to the fuse box 1.

Figure 3:
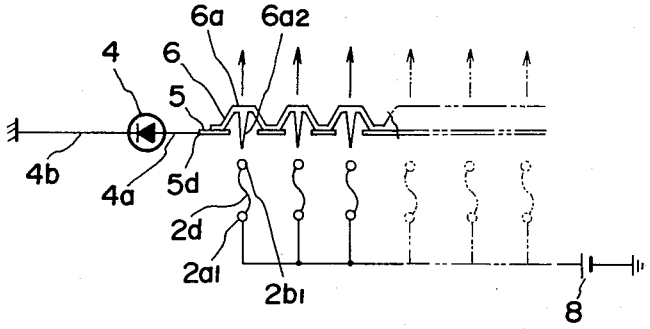
FIG. 3 is an electric connection diagram of the embodiment shown in FIG. 1.

FIG. 3 shows a circuit diagram of the detecting device. It will be seen that the cathode-side lead 4*b* of the light emitting diode 4 is grounded. The positive electrode of a series of batteries 8 mounted on the automobile is connected to the input-side blade 2*a* of the fuse 2, while the negative electrode of the same is grounded.

In use of the detecting device, the detecting device is attached to the fuse box 1 and the contact 6*a* just above the fuse 2 to be examined is depressed so that the contact portion $6a_2$ of the contact 6*a* is pressed against the head $2b_1$ of the blade 2*b* of the fuse 2. If the fuse 2 is sound, an electric current will flow through the fuse 2, contact portion $6a_2$, grounding plate 5 and the light emitting diode 4, so that the light emitting diode 4 emits light to show that the fuse 2 is sound. If the fuse 2 has been burnt-out, the light emitting diode 4 will not light. It will be seen that the burning-out of the fuse can be detected simply by depressing the contact 6*a* above the fuse to be examined. The contact 6*a* is naturally reset as it is relieved from the depressing force by the resiliency of the resilient resetting portion $6a_1$.

Although the invention has been described through its preferred form by way of example, various changes and modifications may be imparted to the described embodiment. For instance, the grounding plate 5 is not essential and can be eliminated. In such a case, the anode-side lead 4*a* of the light emitting diode 4 is connected to the contact bar 6 by means of a connector. It is also possible to use a contact bar 6 consisting of a corresponding number of segments to the number of the fuses, although the described embodiment incorporates an integral contact bar. In such a case, it is preferable to use the grounding plate 5.

From the foregoing description, it will be seen that the protective resistor for protecting the batteries and light emitting diode can be eliminated, because the contact for contacting the blade type fuse is made of electrically conductive rubber. It is also advantageous that a separate resetting member for resetting the contact is dispensed with, because the resiliency of the conductive rubber effectively forces the contact away from the fuse, so that the construction as a whole is simplified. In addition, the large apertures formed in the main body effectively guide the contacts to make sure of a safe contact between the contact and the fuse.

What is claimed is:

1. A device for detecting a burnt fuse in a fuse box accommodating a plurality of parallelly arranged blade-type fuses each having an input end and an output end, said device comprising:

an insulative support body mounted on the fuse box;

resilient contact means supported by said support body in a facing relation to the output end of the blade-type fuses;

a light-emitting element connected between said resilient contact means and ground; and a grounding element electrically connected between said resilient contact means and said light-emitting element, said grounding element and said resilient contact means being in contact with each other in overlapped fashion, over substantially the whole area thereof.

2. A device according to claim 1, wherein said resilient contact means includes an electrically conductive rubber bar member.

3. A device according to claim 2, wherein said electrically conductive rubber bar member has a plurality of truncated and hollow conical portions in association with the respective output ends of the blade-type fuses, said conical portion having recesses which face said output ends, respectively.

4. A device according to claim 2, wherein each truncated hollow conical portion has a contact portion projecting from its recess toward the corresponding output end of each blade-type fuse.

5. A device according to claim 1, wherein said support body includes a panel extending over the output ends of the fuses and has a plurality of apertures corresponding thereto.

* * * * *